United States Patent [19]

Miller

[11] 3,948,496

[45] Apr. 6, 1976

[54] OXYGEN-FUEL CUTTING TORCH

[75] Inventor: Henry A. Miller, Scotch Plains, N.J.

[73] Assignee: Airco, Inc., Montvale, N.J.

[22] Filed: Jan. 16, 1975

[21] Appl. No.: 541,557

[52] U.S. Cl. ..... 266/23 P; 266/23 R; 29/157 C; 29/DIG. 47

[51] Int. Cl.[2] ..... B23K 7/00

[58] Field of Search ..... 29/157 C, DIG. 47; 266/23 R, 23 P, 23 T

[56] References Cited

UNITED STATES PATENTS 3,045,328 7/1962 Turner et al. ..... 29/156.8 H

FOREIGN PATENTS OR APPLICATIONS 123,105 8/1958 U.S.S.R. ..... 29/157 C

*Primary Examiner*—Roy Lake
*Assistant Examiner*—Paul A. Bell
*Attorney, Agent, or Firm*—Edmund W. Bopp; Larry R. Cassett; H. Hume Mathews

[57] ABSTRACT

An oxygen-fuel cutting torch comprises an integral aluminum body extruded to form three straight-through gas feed passages. The passages connect with a laterally mounted gas dispensing tip assembly and have dead-end terminal seals. Source oxygen is divided between a first passage and a second passage for supplying cutting oxygen and preheat oxygen respectively. Fuel gas fed through a third passage mixes with the preheat oxygen within the tip assembly, the preheat oxygen and fuel gas flow rates being adjusted by respective throttling valves. Each valve is seated in a transverse bore hole in the torch body that intersects the corresponding gas passage. Cutting oxygen is fed to the torch tip through a bore-seated valve in the first passage that is opened against spring bias by a manually operated lever.

17 Claims, 11 Drawing Figures

OXYGEN-FUEL CUTTING TORCH

BACKGROUND OF INVENTION

The invention is concerned with cutting torches and in particular to oxygen-fuel cutting torches.

Gas cutting torches utilizing fuel gas and oxygen have been successfully used for many years for cutting work materials such as metal plate and the like. In a typical example, oxygen and a fuel gas such as acetylene are fed to the torch from separate sources. The oxygen is separated into two streams, one of which is mixed with fuel gas at the burning tip or elsewhere for feeding a preheating flame which heats the work material to combustion temperature. The other portion of the divided oxygen stream comprises the cutting oxygen which is separately fed to the torch burning tip for impinging on the preheated zone of the work material to achieve actual cutting of the material.

Cutting torches of the type described above have in the past been designed in a large variety of configurations, including a comparatively complex arrangement of individual tube components which conduct the several gases to the desired points in the apparatus. Valves are positioned in the respective tubes or conduits to regulate and control the flow of the various gases. In a so-called equal pressure torch for example, cutting oxygen, preheat oxygen and fuel gas are fed through individual tubular conduits to the torch tip. Each of these several conduits is in turn secured to other portions of the apparatus such as by heat-joining techniques, including soldering, brazing and the like. Accordingly, a number of joints may be required to join the various conduits thereby adding to complexity in construction. The resulting apparatus is therefore not only relatively costly to construct but often tends to be awkward and uncomfortable to handle as it may possess poor balance and weight distribution; also the arrangement is generally unattractive in appearance.

Accordingly, the present invention is concerned with an improved and relatively inexpensive oxygen-fuel cutting torch having unitary and simplified construction.

SUMMARY OF INVENTION

In accordance with the invention, the construction of the cutting torch is based upon use of an extruded aluminum or similar metallic body having straight-through gas feed passages which are formed during the extrusion process. The passages which are inherently parallel to the longitudinal axis of the extruded body, include a preheat fuel passage, a preheat oxygen passage and a cutting oxygen passage, each of which is valve controlled within the torch body. The cutting oxygen passage, termed a first passage, is supplied with source oxygen for direct application to the torch tip. The second or preheat oxygen passage, has a cross-connection with the first passage and is in effect a branch thereof for dividing the oxygen into two streams. The third or fuel gas passage, is provided with a manually adjustable throttling valve for controlling the rate of fuel gas flow, as is also the second passage for controlling flow-rate of the preheat oxygen. The throttling valves are seated within transverse body bores respectively, that intersect the corresponding gas passages. The torch body at its burning end has a transverse socket-like recess for a tip assembly within which the preheat oxygen and fuel gas are mixed. The cutting oxygen is fed separately through the assembly to the burning tip where it can be applied directly for the cutting function. The cutting oxygen passage has a normally closed control valve that is also seated within an intersecting body bore. It is operated by a manually controlled lever pivoted on the body proper after the preheat flame has sufficiently heated the work material.

A principal object of the present invention therefore is to provide a gas cutting torch the construction of which is centered upon use of a one-piece extruded body, whereby the complexity and cost of construction of the torch are greatly reduced.

It is a further object of the invention to provide a gas cutting torch having a one-piece extruded body with straight-through gas passages that lends itself to simple and inexpensive machine operations for converting the extruded body to an operative cutting torch, and wherein the torch has excellent weight distribution and handling characteristics, and is streamlined and attractive in appearance.

It is a still further object of the invention to provide simplified valve mounting and seating arrangements within the torch body that include transverse body bores intersecting the straight-through gas passages within which respective gas control valves are positioned.

DESCRIPTION OF PREFERRED EMBODIMENT

Figure 1:
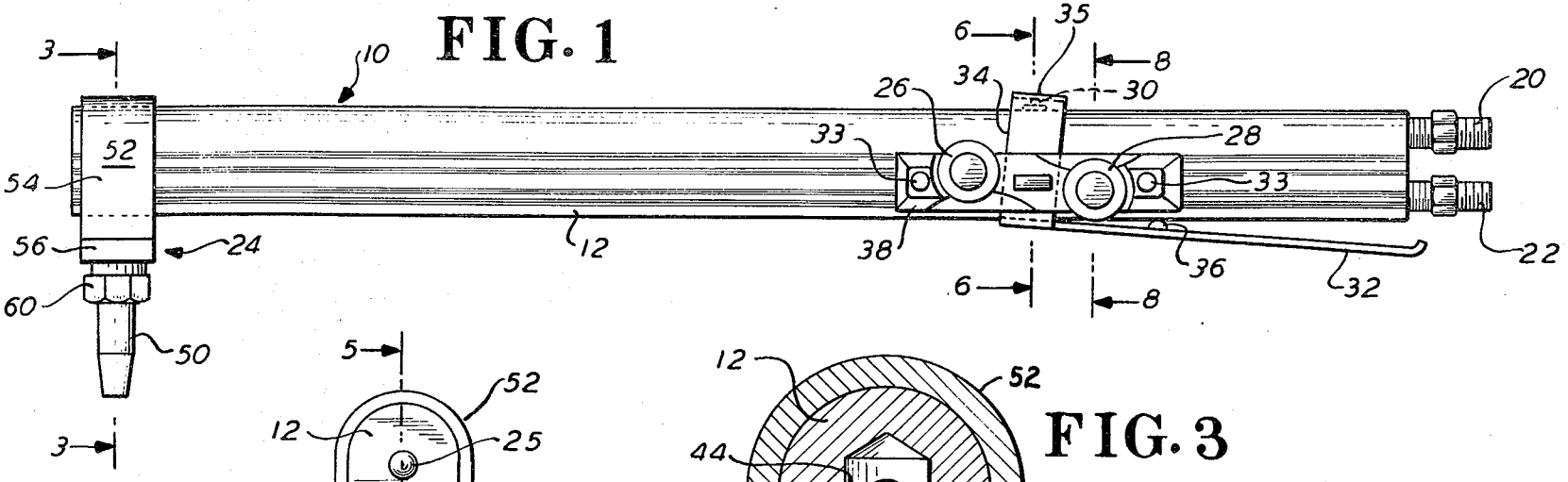
FIG. 1 is a side view of the assembled cutting torch of the present invention showing the arrangement of manual means for operating the respective gas flow control valves.
Figures 5, 6, 7:
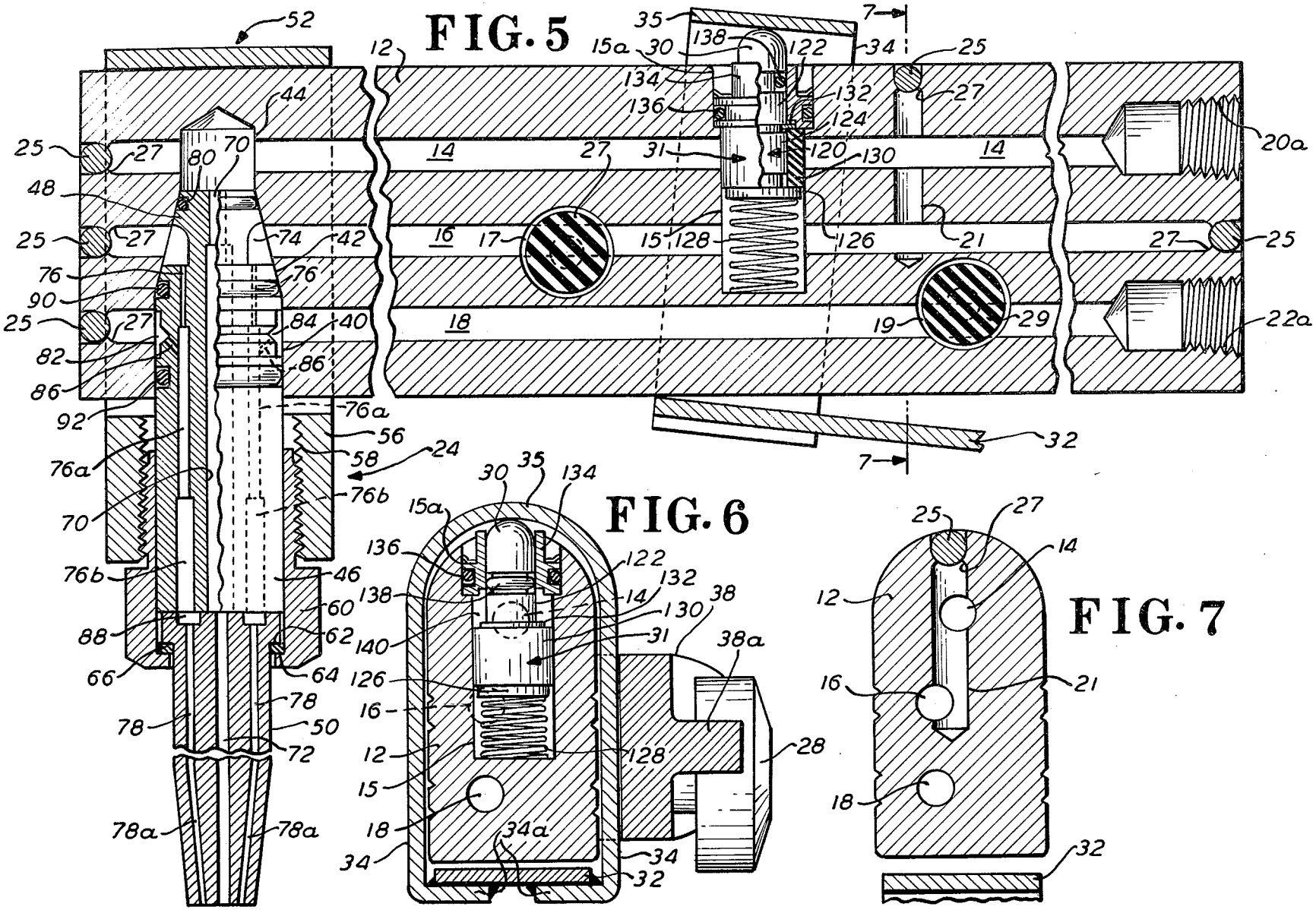
FIG. 5 is a partial longitudinal sectional veiw of the cutting torch taken along the line 5—5 of FIG. 2 with the cutting oxygen valve shown closed.
FIG. 6 is a transverse sectional view taken along the line 6—6 of FIG. 1, showing the cutting oxygen valve of FIG. 5 in open position.
FIG. 7 is a transverse body section view taken along the line 7—7 of FIG. 5.

Referring first to FIGS. 1 and 5, a fully assembled oxygen-fuel cutting torch 10 constructed in accordance with the invention comprises an integral body member 12 that is derived from an extruded length of aluminum or other suitable material which is then cut to the desired torch length. During the extrusion process a plurality of straight-through longidutinal passages 14, 16 and 18, FIG. 5, are formed in the body member for preheat and cutting gas streams as described in more detail below. Briefly, these passages have flow control valves and connect with source oxygen and fuel gas supply couplings 20 and 22 respectively, at the rear or breach end of the torch body, and extend through the body to a gas mixing and dispensing tip assembly 24 at the opposite or burning end. The arrangement of the flow control valves and the gas passages leading from the breach end of the torch will first be described.

As shown in FIGS. 5 and 6 the straight-through passages 14, 16 and 18 are intersected at appropriate points by transverse body bores 15, 17 and 19 respectively, in which are mounted flow control valves as presently described. A transverse bore hole 21 also interconnects the cutting oxygen and preheat oxygen passages 14 and 16 upstream of the bore 15 so that both passages at their junction connect with the oxygen source coupling 20, FIG. 1. The oxygen and fuel passages 14 and 18 are tapped at 20*a* and 22*a* respectively, FIG. 5, for suitable connection with the couplings 20 and 22.

Referring to FIGS. 1 and 5, controls for setting individual flow of the oxygen and fuel preheat gases in passages 16 and 18 respectively, comprise a rotatable knob 26 for manually adjusting a throttling valve 27 in the preheat oxygen stream and a similar knob 28 for a throttling valve 29 in the fuel gas stream. The cutting oxygen stream is separately controlled by a normally closed on-off valve 31 in bore hole 15 having an operating stem 30 that is spring biased to extend a short distance as indicated, above the top edge of the torch body. The valve stem 30 is arranged to be depressed for opening the cutting oxygen valve 31 by a manually actuated lever 32 having at one end a yoke 34 that straddles the torch body 12 so that its upper end 35 is positioned over the valve stem 30. The yoke side members at the lower ends 34*a* are bent inwardly around the lever 32 for making suitable connection therewith, as by spot welding, FIG. 6. A button type fulcrum 36 on the lever bears against the lower side of the torch body as viewed in FIG. 1, to function as the lever pivot for depressing the yoke as the lever is manually pressed toward the torch body. The throttling valve control knobs 26 and 28 are conveniently mounted in a face plate 38 that is formed as a die casting and detachably mounted by screws 33 on the torch body 12.

Figure 2:
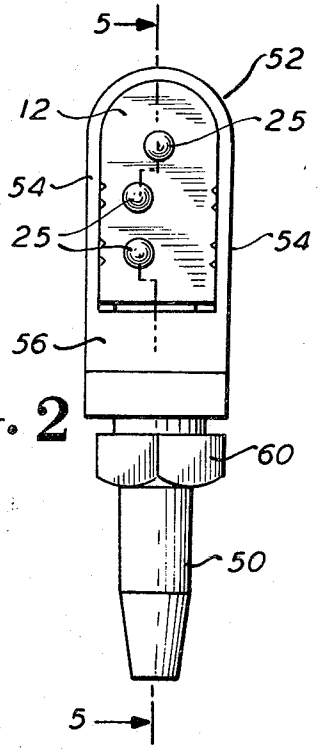
FIG. 2 is an end view of the torch of FIG. 1 showing passage terminal seals as viewed from the left.

As the straight-through passages and transverse bores in several instances require sealing of openings in the torch body, referring to FIGS. 2, 5 and 7, an improved feature of the invention comprises a simplified and inexpensive seal for these dead-end openings. Hard metal balls 25 of steel for example, are force-pressed into the terminal openings respectively, of the passage or bore holes to be sealed, namely, both outer ends of the passage 16, the left ends of the passage 14 and 18 and the upper end of bore 21. As shown in FIG. 5, each ball which is slightly larger in diameter than the corresponding passage or bore hole, pushes some of the comparatively soft aluminum along the side wall ahead of it to form a tight sealing abutment or ring 27 that also tends to lock the ball in place. The ball is pressed into flush relation with the torch body surface, so that it forms an inconspicuous, as well as efficient and easily fabricated, permanent seal. Where preferred, aluminum balls can be used.

Figure 3:
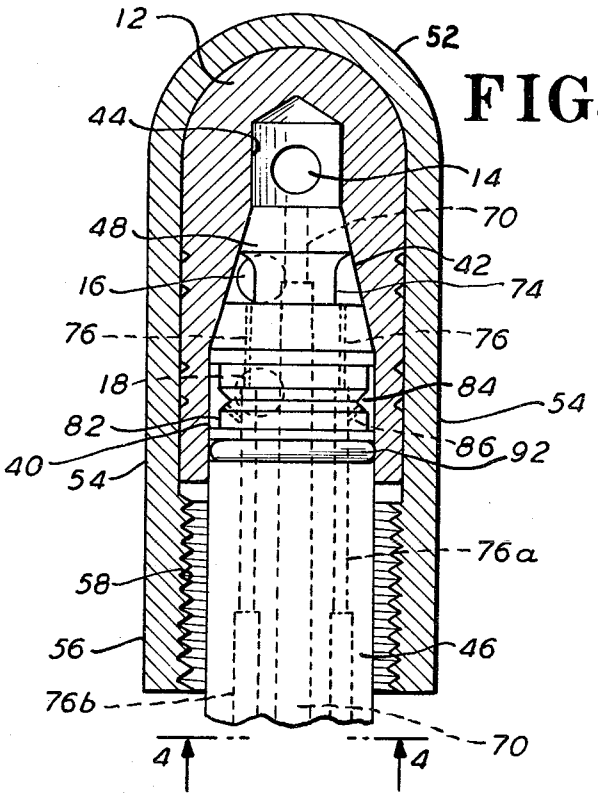
FIG. 3 is a partial view of the tip assembly taken along the body section line 3—3 of FIG. 1.

The torch body at the burning end, FIGS. 3 and 5, has a transverse bore hole of varying diameter that intersects all the straight-through gas passages 14, 16 and 18 to form a socket or recess 40 for seating the mixing tip 24. Thus, the gas passages which are sealed at their outer dead-ends as described above, feed into the passages of the mixing tip. The recess 40 which is cylindrical at the body opening, connects with the preheat fuel passage 18, and has an intermediate cone-like section 42 that connects with the preheat oxygen passage 16. At the inner end of the recess a cylindrical reduced diameter section 44 connects with the cutting oxygen passage 14.

The mixing tip assembly 24 comprises a main body portion 46 that extends within the recess 40 and has a tapered upper end 48 to fit within the conical section 42. The burning tip 50 which is generally cylindrical with a gradual taper toward the flame end, FIG. 5, is made of a suitable material such as copper, and abuts the lower portion of body portion 46 for aligning the respective gas passages. The mixing tip assembly is completed by a body clamp, FIGS. 1 and 2, comprising a yoke 52 that straddles the torch body and has at its lower end a cylindrical section 56 with internal screw threads 58.

The lateral sides 54 of the yoke merge with the outer cylindrical wall of the internally threaded section 56, FIGS. 2 and 3. The assembly portion 46 is partly within the adapter as shown in FIGS. 3 and 5. The flame tip 50 which abuts the portion 46 is held in firm aligning engagement therewith by a coupling sleeve or nut 60 having screw-threaded engagement with the internal threads 58 of the yoke 52. To this end, the tip has an annular shoulder 62 that is engaged by an inner flange 64 of the coupling sleeve as the latter is screwed into the adapter. A resilient ring washer 66 (optional, but not required) may be positioned between the shoulder and engaging flange. Accordingly, it is seen that when the coupling sleeve 60 is properly tightened, the truncated conical portion 48 of the main mixer portion 46 is also forced into snug engagement with the torch body at the conical section 42 of the socket-like recess.

Figure 4:
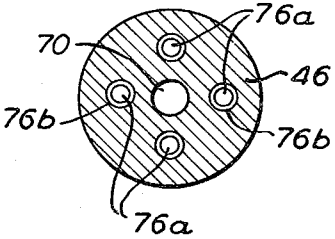
FIG. 4 is a transverse sectional view of the torch tip mixer taken along the line 4—4 of FIG. 3.

The cutting-oxygen passage 14 as best shown in FIG. 5, is directly connected with the upper section 44 of the recess 40 which in turn, is connected through aligned passages 70 and 72 that extend centrally of the portion 46 and flame tip 50 respectively, for direct feed of oxygen to the work piece. For admitting preheat oxygen to the mixing assembly from passage 16, the truncated conical portion 48 is cut away opposite this passage to form an annular groove 74. From the annular pocket so formed between the conical recess wall and portion 48, a plurality of variable diameter passages 76 extend in parallel relation through the cylindrical portion 46 to align with corresponding passages 78 in the tip 50. Four such passages are shown herein, each positioned within a cross-section quadrant of the portion 46 and concentrically of the central cutting oxygen passage 70 as shown in FIG. 4. An O-ring 80 is positioned within a corresponding groove in the truncated portion 48 for making a seal between the cutting and preheat oxygen passages.

The preheat fuel gas from passage 18 is admitted to a shallow annular pocket 82 that is defined by a flat through in the cylindrical portion 46 and the recess wall. The trough is deepened at its center by a V-shape groove 84 that connects through lateral passages 86 respectively, with each of the passages 76 for mixing of the preheat oxygen and fuel gases. In order to facilitate mixing, each oxygen passage 76 includes an enlarged diameter section 76*a* into which a corresponding fuel passage 86 leads; the passage 76*a* in turn, leads into a further enlarged diameter section 76*b*. These series-connected enlarged passages function as gas mixing chambers. The enlarged mixing passages 76*b* for preheat gases connect with an annular plenum 88 in the tip 50 which leads into the more restricted tip passages 78. Sealing O-rings 90 and 92 are positioned within corresponding grooves in the truncated and cylindrical portions 48 and 46 respectively, for maintaining interpassage and body seals for the preheat fuel gases. However, as the O-ring 92 may in practice be sufficient for making the external seal only, the O-rings 80 and 90 for internal sealing may be omitted if desired as indicated in FIG. 3.

As shown in FIG. 5, the mixed preheat gases are directed from the tip passages 78*a* so as to converge and impinge on a small area of the work material a predetermined distance beyond the tip. When the cutting oxygen stream is turned on to flow as described through the central passage 72, the preheat gases which continue to flow at respective set rates through passages 78, converge on the cutting oxygen stream to augment its cutting action.

Figure 8:
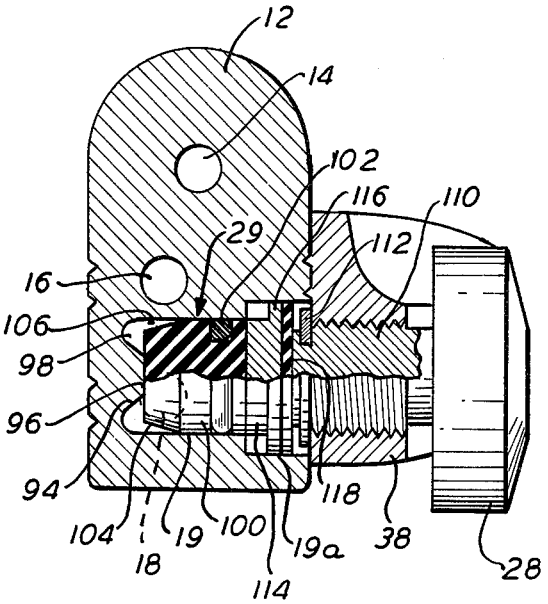
FIG. 8 is a transverse view partly in section, taken generally along the line 8—8 of FIG. 1 showing a gas passage throttling valve in its open position.
Figure 9:
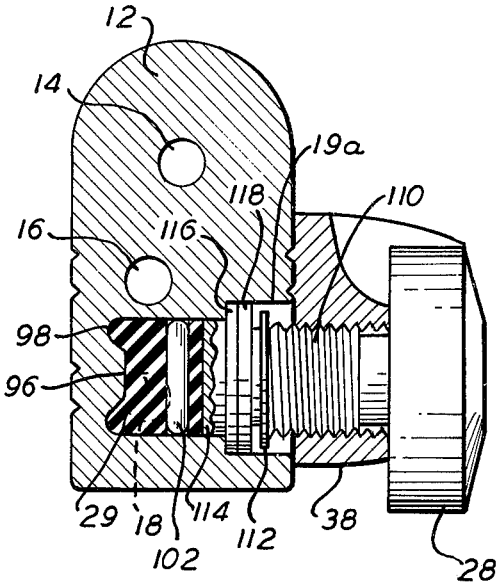
FIG. 9 is a similar view showing the throttling valve adjusted to close off the corresponding gas passage.

The preheat throttling valves 27 and 29 are similar in construction and it is therefore sufficient to show one valve such as the fuel gas throttling valve 29, by way of example. In FIGS. 8 and 9, the valve 29 is shown in the fully open and closed positions respectively. Referring first to FIG. 8, the transverse bore hole 19 which intersects the preheat fuel passage 18, has at its entrance an enlarged diameter section 19*a* and at its closed end centrally thereof a mesa-like projection 94 that functions as the valve seat. The projection 94 which has a planar surface 96 is defined by an annular groove 98 at the outer periphery of the recess that as will be seen, also serves as a cross-passage for the preheat fuel gas when the valve is open. The valve 29 which is positioned within the bore 19 comprises a plug-like member of resilient material such as rubber or "Neoprene", having a generally cylindrical body portion 100. An O-ring 102 makes a gas seal as shown between the valve and the bore wall. The valve portion 100 terminates in a truncated cone portion 104, the truncated surface of which engages the planar surface 96 of the projection 94 in over-hanging relation thereto. Thus, it is seen that the tapered end of the valve defines with the adjacent recess wall an annular passage 106 of "V" cross-section that connects with both openings of the intersected fuel passage 18. As the annular passage 106 is seen to merge with the groove 98, an enlarged continuous passage is formed for flow of the fuel gas through the valve recess and passage 18 when the valve is open as in FIG. 8.

For throttling or shutting off the preheat fuel as desired, the valve 29 is placed under compression so that it is deformed and forced into the spaces at 98 and 106, thereby closing off the preheat fuel passage. In FIG. 9, the valve material is shown squeezed into the groove 98 so that it is completely filled to represent the closed-valve position. By regulating the degree of compression so that the resilient valve material partly fills the cross-passage, the preheat fuel flow can be throttled as required. The preheat oxygen flow is controlled in the same manner by the valve 27.

The compression force can be applied to the resilient valve member in any convenient manner, such as by a simple screw-thread device with adjusting knob 28. In the arrangement shown, the knob 28 has a shank 110 that is screw threaded into the detachable face plate 38 so that upon graduated knob rotation the corresponding linear movement of the shank serves to increase compression of the valve 29, or vice versa. The shank near its end has an annular groove for retaining a flat ring or washer 112 serving as a limit stop at the open-valve position, FIG. 8. The compression or deforming force is transmitted to the valve member through a pressure disc 114 corresponding in diameter to the valve portion 100. The disc has an enlarged annular shoulder 116 which serves as a limit stop in the closed-valve position, FIG. 9, and also as guiding means for the disc within the enlarged diameter entrance 19*a* to the bore hole. A thrust bearing washer 118 of suitable anti-friction material may be positioned between the pressure disc and the moveable end of the shank 110. The throttling valve 27 for the preheat oxygen passage 16 is similarly constructed and arranged for setting flow of preheat oxygen.

The on-off valve 21 for controlling flow of cutting oxygen in the passage 14, FIGS. 5 and 6, is a reciprocally movable assembly having a plunger-like core 120 that is reduced in diameter at three points along the longitudinal axis to form the operating stem 30, a pair of cylindrical portions 122 and 124 and a base pad 126. A biasing spring 128 urges the plunger toward the closed-valve position and into engagement with the operating lever yoke 35. The valve proper consists of a cylindrical sleeve 130 of "Neoprene" or the like that is mounted on the plunger portion 124 between a retaining ring 132 and the base pad 126 to make sealing engagement with the bore wall. In the closed position, the valve sleeve 130, blocks the passage 14 as shown in FIG. 5. In this position, the biasing spring 128 axially compresses the resilient cylindrical sleeve 130, expanding the sleeve so as to fill and seal off the passage 14 from the bore cavity 15. The valve stem 30 and cylindrical member 122 extend and are guided within a fixed bushing 134 which is mounted within the enlarged diameter entrance 15*a* to the bore 15. The bushing is grooved as shown to receive an O-ring 136 for making an external body seal. The plunger in turn has an O-ring 138 on the valve stem for making a sliding seal with the fixed bushing.

The valve bore hole 15 in the present instance intersects the passage 16 as well as passage 14 in order to provide adequate space for the valve biasing spring 128 that is seated between the bottom of the bore and plunger pad 126. The flow of preheat oxygen through the passage 16 is not significantly affected by a compressed and interposed coil spring 128 as will be apparent from FIG. 6. If desired, the biasing spring can be mainly located within a recess in the plunger itself so that the bore hole 15 can be shortened to avoid intersecting the passage 16.

As described in connection with FIG. 1, opening of the cutting oxygen valve is conveniently performed by squeezing the manual lever 32 towards the torch body with one hand, while positioning the torch on the work with the other hand. As the lever is moved in counter-clockwise direction about the fulcrum 36, the yoke 34 is lowered and depresses the valve stem 30, thereby taking the spring load off the valve sleeve 130 and allowing it to contract to its smaller natural diameter for free axial movement within the bore 15. Further depression of the valve stem 30 moves the valve sleeve 130 downward to uncover the oxygen passage 14 as shown in FIG. 6. In this position, the smaller diameter plunger portion 122 (now opposite the passage 14)

defines an annular space 140 in the bore through which the cutting oxygen can flow to the mixing assembly 24. The biasing spring 128 is preferably pretensioned for the open-valve position of FIG. 5 so that the valve stem 30 pushes the yoke 34 upwardly to hold the lower end of the lever 32 firmly against the underside of the torch body.

Figure 10:
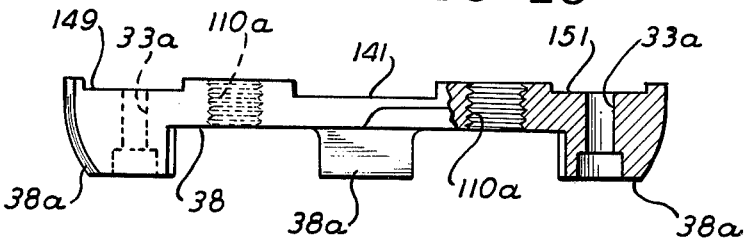
FIG. 10 is a side view, partly in section, of the mounting plate for the throttling valve controls.

The face plate 38 in addition to its function as a mount for the throttling valve adjusting knobs also serves to lock the yoke 34 in place so that it cannot shift longitudinally on the torch body. As shown in FIG. 10, the face plate which is preferably formed as a die casting has at its side facing the torch body a slot 141 in which the corresponding side of the yoke is positioned for free vertical movement. The die casting is formed with holes 33*a* for the plate securing body screws 33 (FIG. 1), and holes 110*a* which are tapped for the screw thread shanks 110 of the respective control knobs. High relief portions 38*a* at opposite sides of the control knobs provide a protective flush mounting therefor.

Figure 11:
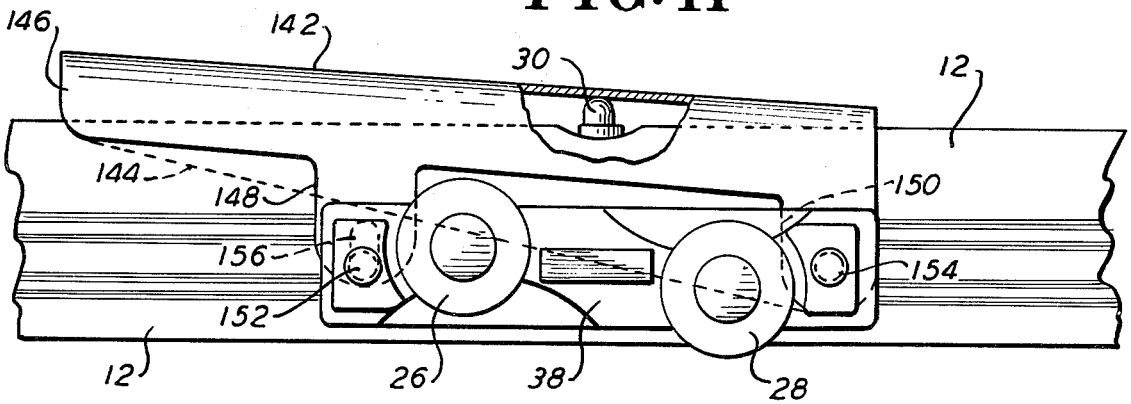
FIG. 11 is a partial side view of the cutting torch showing an alternative form of manual control lever for the cutting oxygen valve.

An alternative manual lever arangement that can be used without change of the torch body structure is shown by FIG. 11. This arrangement may be preferred where the operator finds it more convenient to hold the torch nearer its midsection, and comprises a channel-shape lever 142 that is positioned along and over the upper side of the torch body nearer the center thereof than as shown in FIG. 1. The channel overlies and engages the valve stem 30, and the side flanges 144 and 146 thereof have close spacing with the torch sides. The flange 144 is triangular in form to give more rigidity to the lever, and the flange 146 has a pair of depending tabs 148 and 150 with apertures for guide and pivot pins 152 and 154 respectively, that can in fact be the face plate screws 33 of FIG. 1. The face plate itself is slotted as shown in FIG. 10 so as to adapt the face plate to the use of either the manual lever of FIG. 1 or FIG. 11. The lever tabs 148 and 150 of FIG. 11 are positioned behind the face plate within the slots 149 and 151 respectively, which allow sufficient clearance for the lever to freely pivot about the pin 154 within the limits of the guide tab slot 156. For opening the cutting oxygen valve, the lever 142 is squeezed toward the torch body (as in FIG. 1) for counter-clockwise rotation to depress the valve stem 30.

In brief, the improved oxygen-fuel cutting torch of this invention lends itself to time and cost savings by efficient production techniques such as extrusion of the torch body to include the principal gas passages, and jig-drilling of recesses for the valves, etc.; further, the improved torch is adapted for flexible application to different work conditions, and is rugged, compact, convenient and easily handled, and has an attractive streamlined appearance.

Having set forth the invention in what is considered to be the best embodiment thereof, it will be understood that changes may be made in the system and apparatus as above set forth without departing from the spirit of the invention or exceeding the scope thereof as defined in the following claims.

I claim:

1. An oxygen-fuel cutting torch comprising:

a. an elongated body of extruded metal having a plurality of straight-through gas feed passages formed longitudinally of the body during the extrusion thereof, b. a lateral socket at one end of the torch body extending transversely of and communicating with all the gas feed passages, c. a gas dispensing tip mounted within the socket to receive and distribute gases from the communicating passages respectively, said tip being adapted to direct oxygen from a first passage to a cutting oxygen outlet and to direct oxygen and fuel gas from the second and third passages respectively, to a preheat flame outlet, d. a manually operable valve for controlling feed of cutting oxygen from the first passage to the dispensing tip, e. the second passage and the third passage each being intersected respectively by a transverse bore in the torch body, f. and a manually adjustable throttling valve mounted in each transverse bore for adjusting respectively, the preheat oxygen and fuel gas flow rates.

2. A cutting torch as specified in claim 1, wherein the first passage is also intersected by a bore, and the manually operated cutting oxygen valve is mounted therein.

3. A cutting torch as specified in claim 2, wherein the cutting oxygen valve includes a cylindrical seal that is reciprocally movable within the bore to open and close the first passage.

4. A cutting torch as specified in claim 2, wherein the first passage and the third passage at the entrances thereof are adapted for coupling to oxygen and fuel gas supply lines respectively, and the first and second passages are interconnected within the torch body upstream of the respective valves therein.

5. A cutting torch as specified in claim 1, wherein each throttling valve includes a sealing member of resilient, deformable material that normally is positioned in the respective bore so as to provide clearance for gas flow in the corresponding passage, and manually adjustable means for compressing and deforming the sealing member to restrict gas flow through the passage.

6. A cutting torch as specified in claim 5, wherein the sealing member has a cylindrical body to fit within the bore and at its seating end is formed as a truncated cone, and the valve seat is a raised central portion of the bottom wall of the bore.

7. A cutting torch as specified in claim 1, wherein the torch body has detachably secured thereto a plate covering the bore openings for the throttling valves; and each valve adjusting means comprises a rotatable knob having a shank that is mounted in the plate for linear movement with respect to the valve.

8. A cutting torch as specified in claim 2, wherein the cutting oxygen valve together with its operating stem are spring-biased toward closed position thereby to raise the stem within the bore, and a manually operated lever that is mounted for pivotal movement on the torch body to depress the valve stem and open the valve.

9. A cutting torch as specified in claim 8, wherein the valve stem is at the upper side of the torch body and the operating lever comprises a yoke that surrounds the torch body and overlies the valve stem, and an arm that is attached to the yoke at the under side of the torch body.

10. A cutting torch as specified in claim 8, wherein the operating lever comprises a channel-like member that brackets the torch body and overlies the valve stem, and is pivotally mounted on at least one side of the torch body.

11. A cutting torch as specified in claim 1, wherein the extruded metal is aluminum.

12. A cutting torch as specified in claim 11, wherein the straight-through passages are sealed at dead-end body openings by metal balls respectively, the sealing ball having a diameter greater than that of the corresponding passage.

13. A cutting torch as specified in claim 7, wherein the cutting oxygen valve is operated by a pivoted yoke that encompasses the torch body and the throttling valve plate overlies and is recessed to receive and position the yoke at one side thereof.

14. A cutting torch as specified in claim 7, wherein the cutting oxygen valve is operated by a channel-like lever that overlies the valve and the flange portions positioned under the throttling valve plate, and body securing pins for the plate also constitute pivot and limit stop means respectively, for the lever.

15. A cutting torch as specified in claim 1, wherein the gas dispensing tip comprises elongated cylinder-like means having gas distributing passages including enlarged sections into which the preheat oxygen and fuel gases are directed and mixed prior to discharge at the preheat flame outlet.

16. A cutting torch as specified in claim 15, wherein the elongated means includes a main portion and a burning tip, the main portion being of circular cross-section and mounted at least in part within the torch body socket, the socket engaging end being formed as a truncated cone to fit within a corresponding tapered section of the socket and form a terminal recess for the cutting oxygen passage, the main portion having a central passage extending from the recess to the burning tip and a plurality of parallel mixing passages, each of which connects with both the second and third passages for feeding mixed preheat gases to the burning tip.

17. A cutting torch as specified in claim 15, wherein the elongated means comprises a main portion and a burning tip having aligned cutting oxygen and preheat gas passages respectively, and the elongated means is held within the torch body socket by a yoke around the torch body, the yoke terminating in an adapter section for receiving a coupling nut to clamp the burning tip to the main portion and in turn, force the main portion into firm engagement with the socket.

* * * * *